United States Patent [19]

Landwehr et al.

[11] 4,142,607

[45] Mar. 6, 1979

[54] SILENCER, ESPECIALLY FOR PORTABLE MOTOR CHAIN SAWS

[75] Inventors: Goetz Landwehr, Berglen-Rettersburg; Helmut Lux, Waiblingen; Karl-Heinz Duemmel, Lossburg, all of Fed. Rep. of Germany

[73] Assignee: Firma Andreas Stihl, Waiblingen, Fed. Rep. of Germany

[21] Appl. No.: 835,886

[22] Filed: Sep. 23, 1977

[30] Foreign Application Priority Data

Sep. 25, 1976 [DE] Fed. Rep. of Germany ..... 2643240

[51] Int. Cl.[2] ..... F01N 1/14; F01N 7/00

[52] U.S. Cl. ..... 181/259; 181/229; 181/240; 181/265; 181/272

[58] Field of Search ..... 181/211, 237, 240, 230, 181/258, 259, 264, 266, 268, 274, 275, 282, 224, 262, 265, 243, 229; 60/319, 320; 123/41.64

[56] References Cited

U.S. PATENT DOCUMENTS

| | | | |
|---|---|---|---|
| 3,650,354 | 3/1972 | Gordon | 181/240 |
| 4,060,985 | 12/1977 | Fukushima | 181/259 |

*Primary Examiner*—L. T. Hix
*Assistant Examiner*—Benjamin R. Fuller
*Attorney, Agent, or Firm*—Schwartz, Jeffery, Schwaab, Mack, Blumenthal & Koch

[57] ABSTRACT

Disclosed is an exhaust silencer suitable for use with portable combustion engines, and particularly for use with chain saw engines, comprising a chamber having an inlet and outlet for receiving the engine exhaust; means disposed about the chamber outlet for reducing the kinetic energy of the exhaust flowing therethrough; and an air duct means mounted exteriorly of the chamber below the chamber outlet for cooling the chamber, the kinetic energy reducing means, and the exhaust gas by contact with a stream of ambient air flowing therethrough.

24 Claims, 4 Drawing Figures

SILENCER, ESPECIALLY FOR PORTABLE MOTOR CHAIN SAWS

BACKGROUND OF THE INVENTION

The present invention relates to an exhaust silencer suitable for use with portable combustion engines. More particularly, the present invention relates to an exhaust silencer having a size and weight suitable for use with portable motor saws, especially motor chain saws, and which eliminates the potential fire hazard encountered with conventional chain saw silencers.

Silencers for combustion engines utilized as drive motors for portable motor saws, particularly motor chain saws, are subject to strict safety regulations. These regulations require that the temperature at the surface of the silencer does not exceed 288° C., and that the temperature of the exhaust gases at the location of their exit from the silencer does not exceed 246° C. in order to eliminate the possibility of fire or personal injury. It was found that with exhaust silencers having surface temperatures greater than 288° C. and with an exhaust exit temperature of greater than 246° C. wood chips would occasionally be ignited by contact with the silencer or with the exhaust flowing therefrom, presenting a serious hazard to health and property. Heretofore, however, the prior art has been unable to develop an exhaust silencer which conforms to the above-mentioned temperature limitations and which at the same time possesses a size, weight, and ease of production which renders it suitable for use with small combustion engines, and particularly with chain saw engines.

SUMMARY OF THE INVENTION

Accordingly, it is an object of the instant invention to provide an exhaust silencer conforming to current safety regulations and which additionally has low production costs and a size and weight suitable for use with small combustion engines.

It is an additional object of the present invention to provide an exhaust silencer wherein the surface temperature of the silencer does not exceed 288° C. and the exhaust exit temperature does not exceed 246° C. while maintaining additionally a small size and weight.

It is a specific object of the instant invention to provide an exhaust silencer suitable for use with chain saw engines wherein the surface temperature of the silencer does not exceed 288° C. and the exhaust exit temperature does not exceed 246° C.

In accomplishing the foregoing and other objects, there has been provided in accordance with the present invention an exhaust silencer for portable combustion engines, comprising a chamber having an inlet and outlet for receiving the engine exhaust; means disposed about the chamber outlet for reducing the kinetic energy of the exhaust flowing therethrough; and an air duct means mounted exteriorly of the chamber below the chamber outlet for cooling the chamber, the kinetic energy reducing means, and the exhaust gas by contact with a stream of ambient air flowing therethrough. Preferably the kinetic energy reducing means comprises a duct system passing through the chamber outlet, having an inlet opening in the interior of the chamber and an outlet opening exterior of the chamber such that the engine exhaust is conducted along the exterior of the chamber, and having further at least one turn whereby the path of the duct system is changed by at least approximately 180°.

Through the practice of the instant invention, an exhaust silencer is provided having a size and weight ideally suited for use with chain saw combustion engines. By utilizing a duct system whereby the path of the exhaust gas is made to change direction by at least approximately 180°, an exhaust silencer having a large relaxation path is provided while preserving a small external size. Moreover, by providing an air duct whereby a stream of cooling ambient air is passed over the chamber and intermixed with the exhaust, an exhaust silencer is provided which meets all current safety temperature limitations.

Yet other objects, features, and advantages of the present invention will become apparent to the skilled artisan upon examination of the following detailed description of the present invention, taken with the figures of drawing, wherein:

DETAILED DESCRIPTION OF THE PREFERRED EMBODIMENTS

Figure 1:
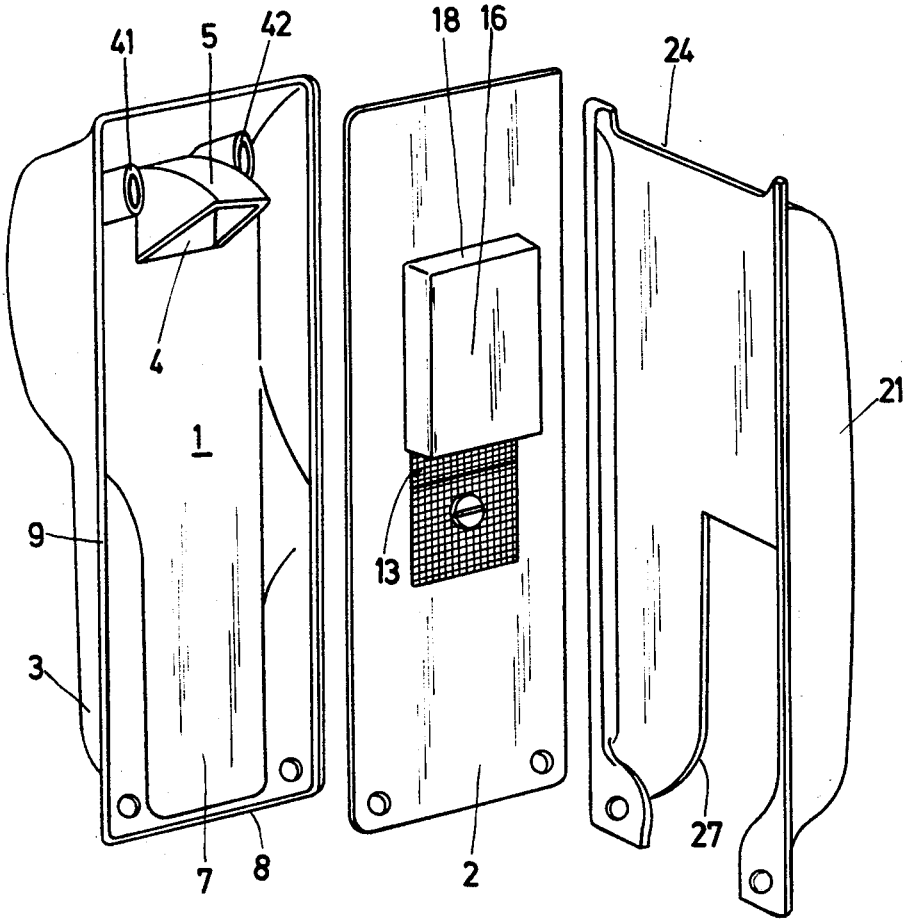
FIG. 1 is an exploded presentation of one embodiment of the silencer of the present invention in a partially opened state.
Figure 2:
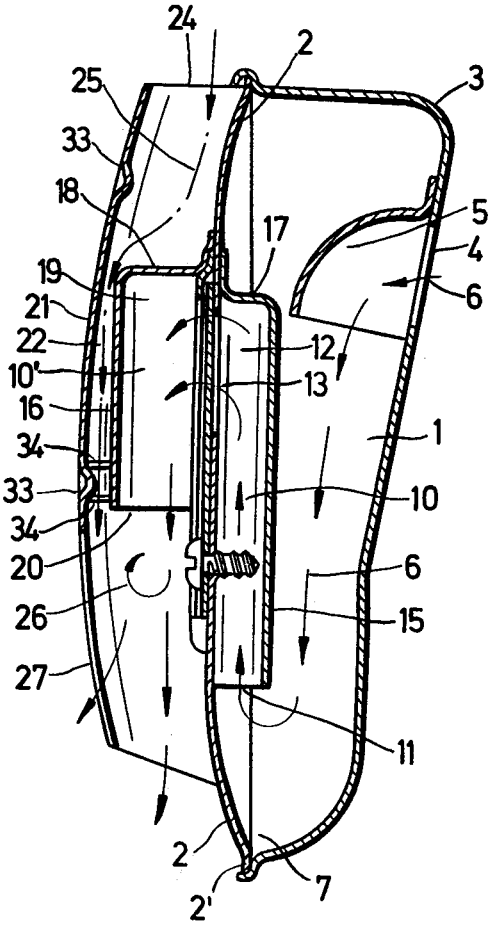
FIG. 2 is a longitudinal section of the embodiment shown in FIG. 1.
Figure 3:
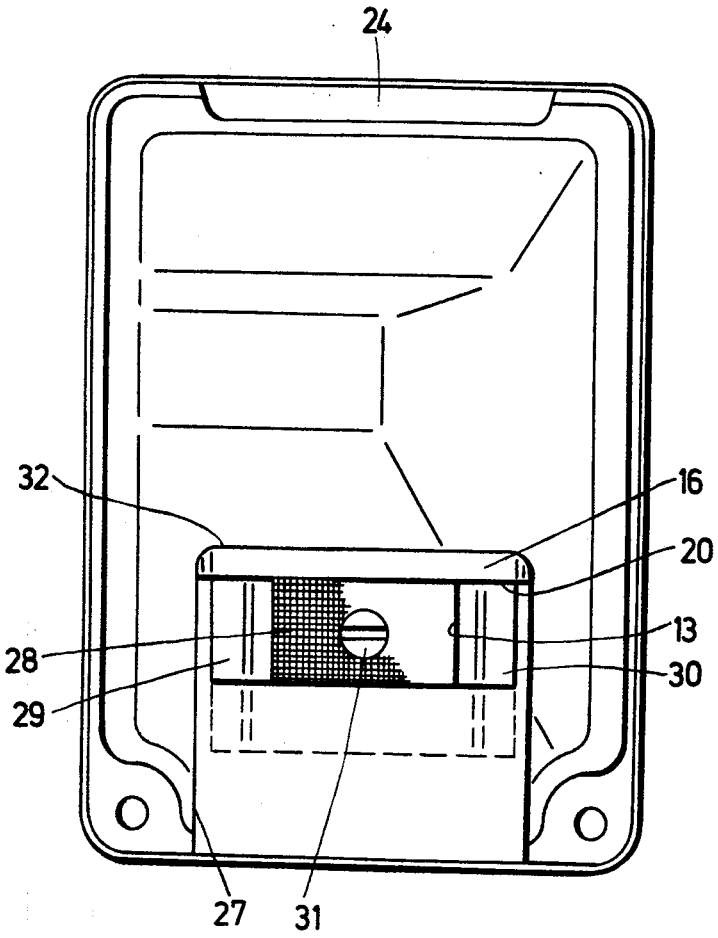
FIG. 3 is a plan view of the silencer of the present invention illustrating the exit opening for the exhaust gases.

Referring to the drawings, FIGS. 1 to 3 illustrate one embodiment of the exhaust silencer of the instant invention intended for use with small combustion engines utilized to power portable motor chain saws. This silencer includes a chamber 1 to receive the exhaust gases, defined by a chamber wall 2 shaped as a plate in its central section and having an outlet 13 therein and by a tub-shaped housing wall 3 made of deep-drawn steel sheet. The housing wall 3 contains an inlet opening 4 for the exhaust gases of the combustion engine, which is not shown. The waste gases may be delivered to the chamber by an exhaust pipe, not shown, which may be mounted on the inlet opening in any manner well known to those skilled in the art, such as for example by fastening with screws. Threaded mounting members 41 and 42 may be provided in the housing wall 3 for this purpose. The inlet opening for the exhaust gases to be silenced communicates with an inlet pipe deflection member 5 welded to the inner wall of the housing wall 3, which deflects the exhaust gases in the manner indicated in FIG. 2 by the broken lines (directional arrow 6) downward.

The directional indications "top" and "bottom" refer to the orientation used in the drawings but not necessarily to the orientation of the silencer when in use. In contrast to the orientation presented in the drawings, the silencer can be employed, such that the exhaust gases entering the deflection member 5 flow from bottom to top.

In the embodiment shown in FIG. 2, the exhaust gases follow the directional arrow 6 and pass into the lower area 7 of chamber 1, limited by the narrow rectangular face of the tub-shaped housing wall 3 and in turn limited by the edge 8 and the two longitudinal sides 9 of the rectangularly shaped housing wall 3 (see FIG.

1), where they are deflected toward the outlet 13 by chamber wall 2.

Disposed about the chamber outlet 13 is a means for reducing the kinetic energy of the exhaust gas flowing through the chamber 1. In one embodiment, this means comprises a duct system passing through the outlet 13, having an inlet opening in the interior of the chamber 1 and an outlet opening on the exterior face of the chamber wall 2 such that the engine exhaust is conducted along the external face of the wall 2, and having further at least one turn whereby the path of the duct system is changed by at lest approximately 180°. In order to provide the longest possible path of relaxation for the pressure waves of the exhaust gases while maintaining the smallest possible external dimensions of the silencer housing, the duct system preferably comprises a gas duct 10 having an inlet 11 and outlet 20 defined by a first channel part 15 (see FIG. 2) and second channel part 16, communicating with the channel part 15 and having its outlet 20 rotated with respect to the inlet 11 by at least 90°. In FIG. 2, the gas duct 10 is shown as having its inlet opening 11 located opposite the inlet opening 4 in the housing wall 3. In the gas duct 10 the kinetic energy of the exhaust gases is further reduced and they are deflected during their passage through the duct 10 by at least approximately 180°. As demonstrated in FIG. 2 in detail, the first part of the duct 10 has a height approximately equal to that of the inlet opening 4 and possesses a turn 12 which deflects the exhaust gas through the outlet 13 arranged in the chamber wall 2. The gases are therefore (see FIG. 2) first deflected by 180° at the inlet opening 11, then within the gas duct 10 by means of the special positioning of channel parts 15 and 16 are first deflected at the outlet 13 by 90° and subsequently by channel part 16, by another 90°. The two channel parts 15 and 16, which may be bent in each case box-like from sheet metal sections, overlap, in the arrangement shown in FIG. 2, the outlet 13 from the inner and the outer side of the chamber wall 2.

As clearly seen in FIG. 2, the channel part 15 is frontally closed with respect to the inlet pipe deflection member 5 and the inlet opening 4 by a transverse wall 17. The channel part 15, together with the channel part 16, may be bent from a metal strip to a U-shaped cross section, having a cross sectional area substantially smaller than the corresponding cross sectional area of chamber 1 as well as that of the outlet 13. The two channel parts 15 and 16 overlap the outlet 13, with the frontal transverse wall 17 of the channel part 15 and the frontal transverse wall 18 of the channel part 16 displaced upwards outside the outlet 13, thus shielding the deflecting zone defined by the turn 12 located in channel part 15 and channel part 16, within the area of the outlet 13.

The channel part 16 is parallel to the chamber wall 2 and terminates in an outlet opening 20, which is recessed slightly with respect to the inlet 11 of the channel port 15.

In order to produce a cooling of the exhaust gases and the silencer housing thereby preventing a possible fire hazard arising through contact of saw chips with the housing of the silencer, there is also provided that onto the boundary 2 of chamber 1, which is flat within its central area, a covering hood 21 is spacedly mounted below the channel part 16 on the external side of chamber wall 2. The covering hood 21 forms an air duct 22 and is in contact with ambient air through at least one opening 24. Through the opening 24, a stream of cooling air enters from the environment as indicated by the dash-dotted lines. This cooling air mixes with the exhaust gases entering the duct 22 through channel port 16 with the formation of vortices as indicated at 26, whereupon the waste gases leave the silencer in a strongly cooled state through the cutout 27 in the hood 21, which appears rectangular in the top view of FIG. 3. The flow 25 of the cooling air in addition passes by closely to the external surface of the channel part 16, whereby the latter is also cooled with a concommitant reduction in the temperature of the exhaust gases flow therethrough.

The outlet 13 in the chamber wall 2, which is extensively shielded by the gas duct 10, is conveniently covered by a wire screen 28 intended to prevent the escape of glowing particles. The screen 28 is inserted between two sheet metal slats 29 and 30, located on both sides of the outlet 13, so that the screen can be easily replaced as necessary. The screen 28 is secured over the outlet 13 with the aid of a shelf-cutting screw, the head of which, not identified here in more detail, is arranged directly above the exit opening 20 of the channel part 16 so that the screw can be reached easily with a screw driver through the cutout 27.

In order to increase the rigidity of the hood 21, transverse and/or longitudinal ribs 33 may be provided upon it. In addition, along the upper edge 32 of the cutout 27, a metal strip 34 may be welded to the inside of the hood. The chamber wall 2 and the hood 21 may be connected in any suitable manner well known to those skilled in the art with the housing part 3; preferably, however, the contact area of the mating surfaces of the covering hood 21 with the silencer housing should be kept as small as possible, in order to minimize heat transfer.

Figure 4:
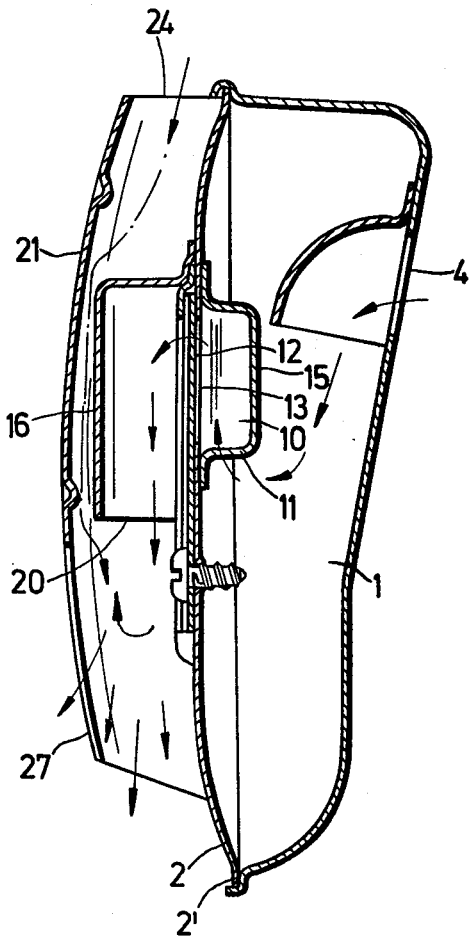
FIG. 4 is a longitudinal section of a modified form of the embodiment illustrated in FIG. 1.

FIG. 4 illustrates a modification of the embodiment shown in FIG. 1, wherein all structural parts which correspond to the structural parts of the embodiment of FIG. 1 are provided with the same reference numbers as in FIGS. 1 to 3. In this embodiment of the instant exhaust silencer, the first channel part 15 is located transversely to the second channel part 16. Accordingly, the inlet opening 11 of this transverse channel part 15 is rotated by approximately 90° with respect to the outlet opening 20 of the channel part 16, the channel parts 15, 16 again being located in different planes.

Alternatively, the kinetic energy reducing means may comprise, instead of the gas duct 10, a membrane valve disposed within the outlet 13, as would be obvious to those skilled in the art.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. An exhaust silencer for portable combustion engines, comprising:

a. a chamber for receiving said engine exhaust, said chamber being defined by a tub-shaped housing having an inlet opening for the exhaust gases, and by a wall member having an opening therein forming an outlet from the chamber;

b. means disposed about the chamber outlet for reducing the kinetic energy of the exhaust gas flowing through the chamber; and c. a tub-shaped covering hood having at least one inlet for ambient air and an outlet for exhaust gas secured to said chamber along the exterior surface of said chamber wall member for cooling said wall member, said kinetic energy reducing means, and said engine exhaust by contact with a stream of ambient air flowing therethrough.

2. The silencer of claim 1, wherein the inlet opening of said chamber is located on a longitudinal face of said tub-shaped housing.

3. The silencer of claim 2, wherein said chamber contains an exhaust gas deflecting member secured about said inlet opening for directing the exhaust gas flow along the inner surface of said tub-shaped housing.

4. The silencer of claim 1, wherein said kinetic energy reducing means comprises a duct system passing through said chamber outlet, having an inlet opening in the interior of said chamber and an outlet opening on the exterior of said chamber such that the engine exhaust is conducted along the external side of said wall member, and having further at least one turn whereby the path of said duct system is changed by at least approximately 180°.

5. The silencer of claim 4, wherein said duct system contains two turns of approximately 90° in different horizontal planes.

6. The silencer of claim 5, wherein said duct system comprises first and second channel members mounted with one channel member on each side of said chamber wall member over said chamber outlet.

7. The silencer of claim 6, wherein the channel members have a transverse wall on their frontal side away from the duct system inlet and outlet, said walls forming said two approximately 90° turns in said duct system.

8. The silencer of claim 7, wherein said channel members comprise sheet metal bent in the shape of boxes.

9. The silencer of claim 7, wherein said chamber opening is covered by a wire screen removably mounted on the outside of said chamber wall member.

10. The silencer of claim 9, wherein said wire screen is secured over said chamber outlet by a screw located beyond the outlet of said second channel member.

11. The silencer of claim 7, wherein said duct system inlet is arranged oppositely to the in-flow direction of the engine exhaust.

12. The silencer of claim 7, wherein said duct system inlet is arranged transversely to the in-flow direction of the engine exhaust.

13. The silencer of claim 5, wherein the duct system outlet faces in the same direction as the in-flow direction of the engine exhaust.

14. The silencer of claim 1, wherein the contact area of the mating surfaces of said covering hood with said chamber housing is kept as small as possible to minimize heat transfer.

15. The silencer of claim 14, wherein said covering hood is provided with reinforcing ribs.

16. The silencer of claim 1, wherein said means for reducing the kinetic energy of the exhaust gas comprises a membrane valve.

17. An exhaust silencer for portable combustion engines, comprising:

a. a chamber for receiving said engine exhaust, said chamber being defined by a tub-shaped housing having an inlet opening for the exhaust gases, and by a wall member having an opening therein forming an outlet from the chamber;

b. a duct system disposed about the chamber outlet for reducing the kinetic energy of the exhaust gas flowing through the chamber, said duct system comprising first and second channel members mounted with one channel member on each side of said chamber wall member over said chamber outlet, said duct system having an inlet opening in the interior of said chamber and an outlet opening on the exterior of said chamber such that the engine exhaust is conducted along the external side of said wall member, and having further two turns of approximately 90° in different horizontal phases; and c. an air duct means secured to said chamber along the exterior surface of said chamber wall member for cooling said wall member, said kinetic energy reducing means, and said engine exhaust by contact with a stream of ambient air flowing therethrough.

18. The exhaust silencer of claim 17, wherein the inlet opening of said chamber is located on a longitudinal face of said tub-shaped housing.

19. The silencer of claim 18, wherein said chamber contains an exhaust gas deflecting member secured about said inlet opening for directing the exhaust gas flow along the inner surface of said tub-shaped housing.

20. The silencer of claim 17, wherein the channel members have a transverse wall on their frontal side away from the duct system inlet and outlet, said walls forming said two approximately 90° turns in said duct system.

21. The silencer of claim 20, wherein said duct system inlet is arranged oppositely to the in-flow direction of the engine exhaust.

22. The silencer of claim 20, wherein said duct system inlet is arranged transversely to the in-flow direction of the engine exhaust.

23. The silencer of claim 20, wherein the duct system outlet faces in the same direction as the in-flow direction of the engine exhaust.

24. The silencer of claim 17, wherein said air duct means comprises a tub-shaped covering hood having at least one inlet for ambient air and an outlet for the exhaust gas.

* * * * *